US010982586B2

(12) United States Patent
Sakaray et al.

(10) Patent No.: US 10,982,586 B2
(45) Date of Patent: Apr. 20, 2021

(54) DISTRIBUTED COOLING SYSTEM FOR A WORK MACHINE

(71) Applicant: Caterpillar Inc., Deerfield, IL (US)

(72) Inventors: Umakanth Sakaray, Dunlap, IL (US); Samantha Sergott, Dunlap, IL (US); Steven Johnson, Metamora, IL (US); David Copley, Peoria, IL (US); Mark Howlett, Northampton (GB)

(73) Assignee: Caterpillar Inc., Peoria, IL (US)

( * ) Notice: Subject to any disclaimer, the term of this patent is extended or adjusted under 35 U.S.C. 154(b) by 10 days.

(21) Appl. No.: 16/267,617

(22) Filed: Feb. 5, 2019

(65) Prior Publication Data

US 2020/0248614 A1 Aug. 6, 2020

(51) Int. Cl.

| | |
|---|---|
| ***F01P 11/10*** | (2006.01) |
| ***E02F 9/08*** | (2006.01) |
| *F01P 11/12* | (2006.01) |
| *F01P 1/00* | (2006.01) |

(52) U.S. Cl.

CPC ..... *F01P 11/10* (2013.01); *E02F 9/0866* (2013.01); *F01P 11/12* (2013.01); *F01P 2001/005* (2013.01); *F01P 2025/48* (2013.01)

(58) Field of Classification Search

CPC .. F01P 7/165; F01P 2060/04; F01P 2003/006; F01P 7/14; F01P 2005/025; F01P 2003/008; F01P 5/02; F02D 2200/023

See application file for complete search history.

(56) References Cited

U.S. PATENT DOCUMENTS

| | | | | |
|---|---|---|---|---|
| 3,949,844 | A * | 4/1976 | Larson | F16D 65/853 188/264 P |
| 6,729,270 | B1 | 5/2004 | Betz et al. | |
| 6,959,671 | B2 | 11/2005 | Nakagawa et al. | |
| 8,047,319 | B2 | 11/2011 | Maier | |
| 8,402,929 | B2 | 3/2013 | Marsh et al. | |
| 2001/0029907 | A1 * | 10/2001 | Algrain | F01P 3/18 123/41.29 |

(Continued)

FOREIGN PATENT DOCUMENTS

| | | | |
|---|---|---|---|
| CN | 108625970 | A | 10/2018 |
| JP | 01170709 | A * | 7/1989 |

(Continued)

*Primary Examiner* — George C Jin
*Assistant Examiner* — Teuta B Holbrook
(74) *Attorney, Agent, or Firm* — Harrity & Harrity LLP

(57) ABSTRACT

A distributed cooling system is disclosed. The system may include a first radiator to circulate a liquid coolant through the first radiator to cool the liquid coolant, a first fan, electrically connected to the first radiator, to facilitate cooling the liquid coolant, and a first temperature sensor to obtain first temperature data concerning the liquid coolant. The system may include a second radiator to circulate an oil through the second radiator to cool the oil, a second fan, electrically connected to the second radiator, to facilitate cooling the oil, and a second temperature sensor to obtain second temperature data concerning the oil. The system may include a heat exchanger to cool the liquid coolant and the oil and a controller, electrically connected to the first fan, the first temperature sensor, the second fan, and the second temperature sensor, to control the first fan and the second fan.

20 Claims, 3 Drawing Sheets

(56) References Cited

U.S. PATENT DOCUMENTS

| | | | | |
|---|---|---|---|---|
| 2005/0006048 | A1* | 1/2005 | Vuk | B60K 11/04 165/41 |
| 2007/0051326 | A1* | 3/2007 | Bering | F01P 5/06 123/41.71 |
| 2009/0235879 | A1* | 9/2009 | Ikeda | E02F 9/00 123/41.49 |
| 2011/0105005 | A1* | 5/2011 | Spaggiari | B60H 1/00828 454/75 |
| 2011/0303472 | A1* | 12/2011 | Robinson | B60K 11/04 180/68.1 |
| 2011/0308763 | A1 | 12/2011 | Charnesky et al. | |
| 2012/0097465 | A1 | 4/2012 | Leffert et al. | |
| 2012/0247753 | A1* | 10/2012 | Bachmann | B60H 1/00278 165/287 |
| 2013/0153180 | A1* | 6/2013 | Montocchio | B60K 11/04 165/121 |
| 2013/0305717 | A1* | 11/2013 | Roehr | E02D 3/026 60/605.2 |
| 2015/0114323 | A1* | 4/2015 | Paetkau | F01P 3/20 123/2 |
| 2015/0176446 | A1* | 6/2015 | Leck | F02C 6/12 60/605.3 |
| 2016/0363035 | A1* | 12/2016 | Solazzo | F01P 7/10 |
| 2019/0241060 | A1* | 8/2019 | Hara | B60K 11/04 |
| 2020/0102880 | A1* | 4/2020 | Loya | F02B 29/0443 |

FOREIGN PATENT DOCUMENTS

| | | | | |
|---|---|---|---|---|
| WO | 2018208208 | | 11/2018 | |
| WO | WO-2018208208 | A1 * | 11/2018 | B60K 11/02 |

* cited by examiner

DISTRIBUTED COOLING SYSTEM FOR A WORK MACHINE

TECHNICAL FIELD

The present disclosure relates generally to a cooling system and, more particularly, to a distributed cooling system for a work machine.

BACKGROUND

A work machine, such as an articulated dump truck and/or other heavy equipment, is used to perform work-intensive tasks. To effectively perform these tasks, a work machine includes numerous components, such as a liquid cooled internal combustion engine, a powertrain, and/or the like. The powertrain may include one or more components, such as a transmission, one or more drive shafts, one or more differentials, one or more final drives, one or more axle systems, one or more braking systems, and/or the like. In some cases, as the work machine performs the tasks, the liquid cooled internal combustion engine and/or the one or more components of the power train become hot and need to be cooled. The work machine may use a cooling system that includes a radiator, a heat exchanger, a fan, and/or the like to cool a liquid coolant that is to cool the liquid cooled internal combustion engine and an oil (e.g., an oil to provide lubrication) that is to cool at least one component of the one or more components of the powertrain. However, such a cooling system utilizes a high-powered fan that require a significant amount of energy to operate and thereby decreases the efficiency of the cooling system.

One attempt to increase the cooling capacity of a work machine having an engine and a powertrain is disclosed in U.S. Pat. No. 6,729,270 that issued to Caterpillar Inc. on May 4, 2004 ("the '270 patent"). In particular, the '270 patent discloses a cooling circuit having a first and second powertrain oil cooler to provide greater engine cooling through a radiator without increasing the size of the radiator. Per the '270 patent, a coolant entering the radiator is at a higher temperature after passing through the second powertrain oil cooler which causes a higher differential between the temperature of the coolant entering the radiator and ambient air, which increases the total amount of heat transfer of the radiator.

While the cooling circuit of the '270 patent may increase the cooling capacity of a work machine, the '270 patent discloses using a single radiator, which would require use of one or more high-powered fans. Moreover, the cooling circuit of the '270 patent is directed to providing increased cooling to powertrain oil, but not to cooling the coolant. The '270 patent does not disclose using a heat exchanger with multiple radiators to cool the coolant with powertrain oil when the powertrain oil is cooler than the coolant and to cool the powertrain oil with coolant when the coolant is cooler than the powertrain oil. Additionally, the '270 patent does not disclose selectively controlling one or more fans associated with multiple radiators to facilitate cooling of the coolant and powertrain oil. Therefore, the distributed cooling system for a work machine of the present disclosure solves one or more problems set forth above and/or other problems in the art.

SUMMARY

According to some implementations, the present disclosure is related to a system. The system may include a first radiator to circulate a liquid coolant through the first radiator to cool the liquid coolant, a first fan, connected to the first radiator, to facilitate cooling the liquid coolant, and a first temperature sensor to obtain first temperature data concerning the liquid coolant. The system may include a second radiator to circulate an oil through the second radiator to cool the oil, a second fan, connected to the second radiator, to facilitate cooling the oil, and a second temperature sensor to obtain second temperature data concerning the oil. The system may include at least one heat exchanger to cool the liquid coolant and/or the oil. The system may include a controller, electrically connected to the first fan, the first temperature sensor, the second fan, and/or the second temperature sensor to control the first fan and/or the second fan.

According to some implementations, the present disclosure is related to a cooling system. The cooling system may include a first radiator to cool a liquid coolant that cools an engine, a first fan, connected to the first radiator, to facilitate cooling the liquid coolant, and a first temperature sensor to obtain first temperature data concerning the liquid coolant. The cooling system may include a second radiator to cool an oil that lubricates a powertrain system, a second fan, connected to the second radiator, to facilitate cooling the oil, and a second temperature sensor to obtain second temperature data concerning the oil. The cooling system may include a heat exchanger to facilitate the liquid coolant cooling the oil and the oil cooling the liquid coolant. The cooling system may include a controller, electrically connected to the first fan, the first temperature sensor, the second fan, and the second temperature sensor to control the first fan and/or the second fan.

According to some implementations, the present disclosure is related to a machine. The machine may include an engine, a brake oil circulation system, and a heat exchanger to fluidly connect with one or more of the engine or the brake oil circulation system. The heat exchanger may be configured to facilitate cooling of a liquid coolant that cools the engine or a brake oil used in the brake oil circulation system. The machine may include a first radiator to fluidly connect with the engine and that may be configured to cool the liquid coolant that cools the engine. The machine may include a first fan, coupled to the first radiator, configured to facilitate cooling the liquid coolant. The machine may include a second radiator to fluidly connect with the brake oil circulation system and that may be configured to cool the brake oil used in the brake oil circulation system. The machine may include a second fan, coupled to the second radiator, configured to facilitate cooling the brake oil. The machine may include a controller, electrically connected with the first fan and/or the second fan to control one or more of the first fan or the second fan to facilitate one or more of cooling the liquid coolant or cooling the brake oil.

DETAILED DESCRIPTION

This disclosure relates to a distributed cooling system. The distributed cooling system has universal applicability to any work machine utilizing such a distributed cooling system. The term "work machine" may refer to any machine that performs an operation associated with an industry such as, for example, mining, construction, farming, transportation, or any other industry. As some examples, the work machine may be a vehicle, an articulated dump truck, a mining truck, a backhoe loader, a cold planer, a wheel loader, a compactor, a feller buncher, a forest machine, a forwarder, a harvester, an excavator, an industrial loader, a knuckleboom loader, a material handler, a motor grader, a pipelayer, a road reclaimer, a skid steer loader, a skidder, a telehandler, a tractor, a dozer, a tractor scraper, or other above ground equipment, underground equipment, or marine equipment.

Figure 1:
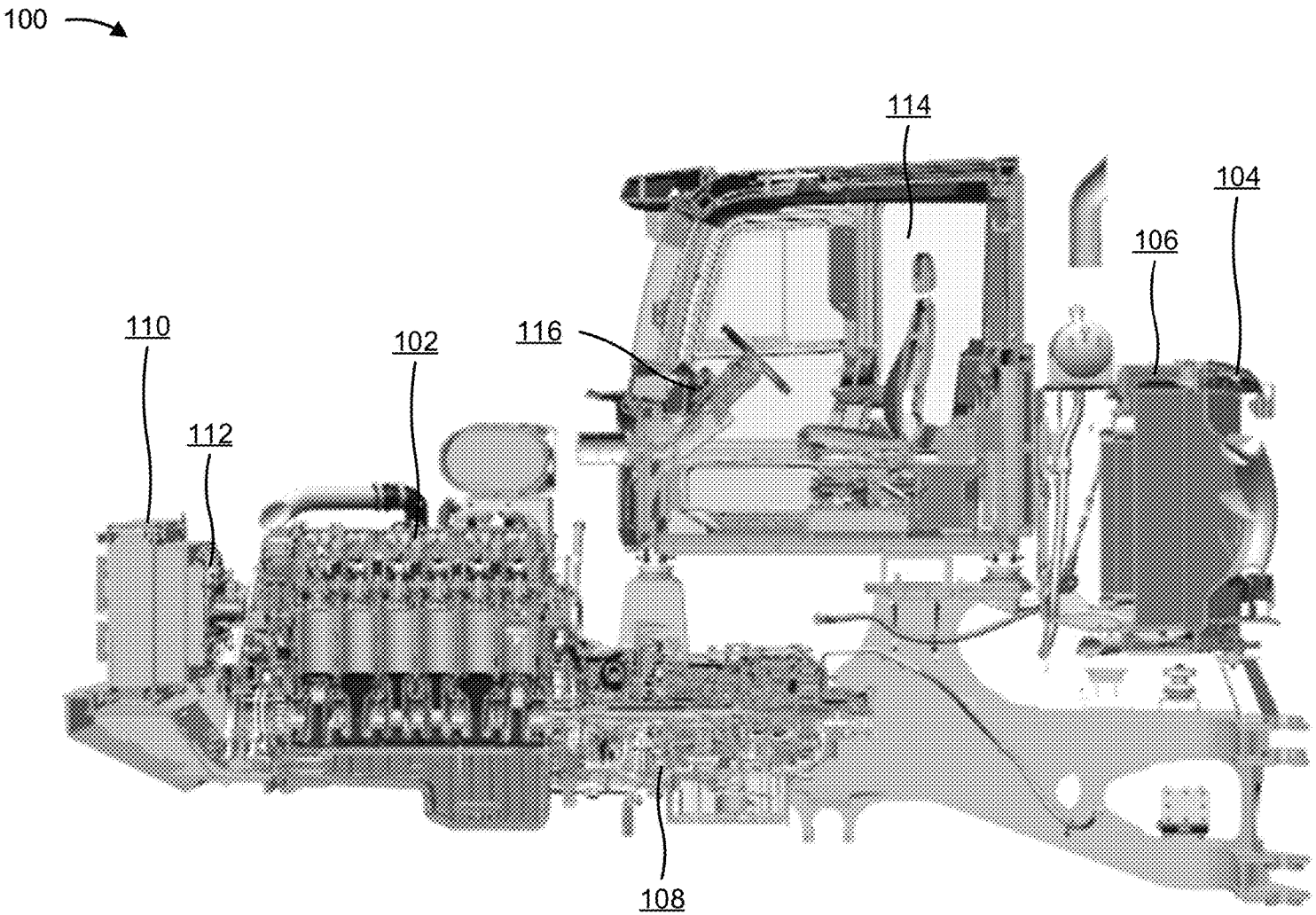
FIG. 1 is a diagram of an example work machine that includes a distributed cooling system.

FIG. 1 is a diagram of an example work machine 100 described herein. Work machine 100 may include an engine 102, such as a liquid cooled internal combustion engine, that is cooled by a liquid coolant. The liquid coolant may be circulated through engine 102 and a first radiator 104. A first fan 106 may direct airflow at first radiator 104 to facilitate cooling of the liquid coolant as the coolant circulates through first radiator 104. Work machine 100 may include a powertrain 108 that uses one or more oils to provide lubrication and cooling. The one or more oils may be circulated through powertrain 108 and a second radiator 110. A second fan 112 may direct airflow at second radiator 110 to facilitate cooling of the one or more oils as the one or more oils circulate through second radiator 110. Work machine 100 may include a cab 114 where an operator can interact with a control console 116 to operate work machine 100. As shown in FIG. 1, first radiator 104 and first fan 106 may be located behind cab 114 (e.g., facing the back of the operator when the operator is in cab 114 interacting with control console 116) and second radiator 110 and second fan 112 may be located in front of engine 102 (e.g., at the front of working machine 100 and facing engine 102).

As indicated above, FIG. 1 is provided as an example. Other examples may differ from what is described in connection with FIG. 1.

Figure 2:
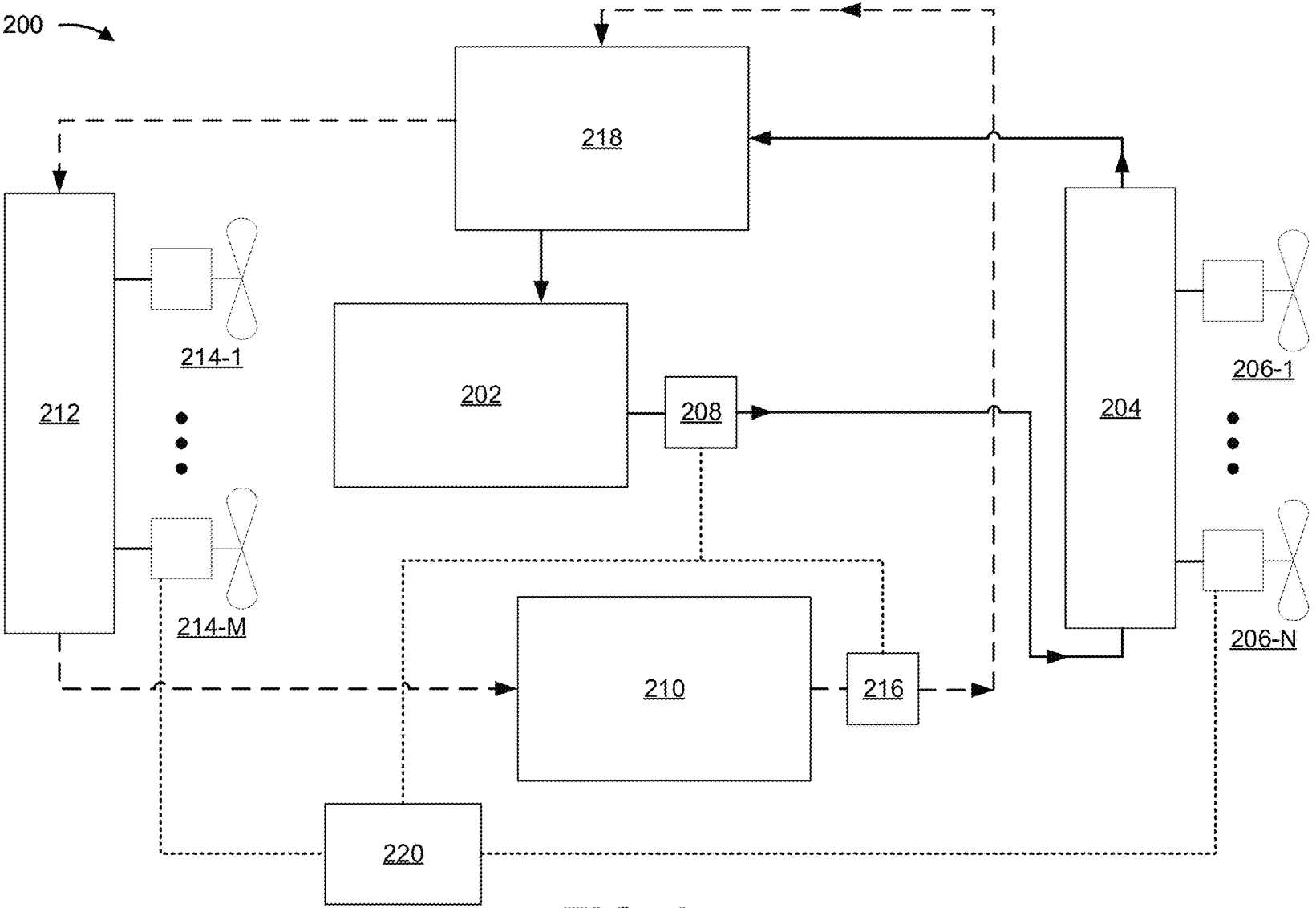
FIG. 2 is a diagram of an example distributed cooling system that may be used with the work machine of FIG. 1.

FIG. 2 is a diagram of an example distributed cooling system that may be used with work machine 100 described herein. As shown in FIG. 2, distributed cooling system 200 may include an engine 202, a first radiator 204, a plurality of first fans 206 (shown as first fan 206-1 to first fan 206-N, where N is an integer and N≥1), a first temperature sensor 208, a powertrain system 210, a second radiator 212, a plurality of second fans 214 (shown as second fan 214-1 to second fan 214-M, where M is an integer and M≥1), a second temperature sensor 216, a heat exchanger 218, and a controller 220. The plurality of first fans 206 may be referred to herein collectively as "first fan 206" or individually as "first fan 206." The plurality of second fans 214 may be referred to herein collectively as "second fan 214" or individually as "second fan 214."

Engine 202 may include an internal combustion engine that produces mechanical and/or electrical power output. Engine 202 may be a gasoline engine, a gaseous fuel-powered engine, a diesel engine, or any other type of internal combustion engine. Engine 202 may be a liquid-cooled engine that uses a liquid coolant to cool the engine. Engine 202 may include at least one component, such as a coolant chamber, a water jacket component, and/or the like for allowing the liquid coolant to circulate through engine 202 to cool the engine.

First radiator 204 may fluidly connect to engine 202. For example, first radiator 204 may be connected to engine 202 via conduits, hoses, and/or the like, to allow the liquid coolant to circulate through engine 202 and first radiator 204 to cool the liquid coolant. First radiator 204 may be a liquid-coolant-to-air cooler to cool the liquid coolant. First fan 206 may be mounted on, integrated into, attached to, and/or affixed to first radiator 204. First fan 206 may direct airflow at first radiator 204 to facilitate cooling of the liquid coolant as the liquid coolant circulates through first radiator 204. For example, first fan 206 may be pointed toward first radiator 204 to direct airflow produced by the first fan 206 at first radiator 204 to cool first radiator 204 and thereby facilitate cooling the liquid coolant. First fan 206 may produce an amount of airflow within an airflow amount range, such as 5,000-45,000 cubic meters per hour. First fan 206 may have one or more speeds. As one example, first fan 206 may have a first speed of 600 revolutions per minute (RPM) and a second speed of 2,300 RPM. First fan 206 may operate via a mechanically driven component of engine 202, via direct current electricity generated by engine 202, and/or the like.

First temperature sensor 208 may be a liquid coolant temperature sensor. First temperature sensor 208 may determine a temperature associated with engine 202 and/or the liquid coolant used by engine 202, such as a temperature of the engine 202; a temperature of a component of engine 202, such as a coolant chamber, a water jacket component, and/or the like of engine 202; a temperature of the liquid coolant; and/or the like. The first temperature sensor 208 may send first temperature data (e.g., first temperature data concerning the temperature associated with engine 202 and/or the liquid coolant) to controller 220 via one or more electrical connections. The first temperature sensor 208 may send a signal to controller 220 indicating whether the temperature of the liquid coolant satisfies a first temperature threshold (e.g., whether the temperature of the liquid coolant is greater than or equal to the first temperature threshold, whether the temperature of the liquid coolant is less than the first temperature threshold, and/or the like).

Engine 202 may engage powertrain system 210 to propel work machine 100 and/or operate components of work machine 100. Powertrain system 210 may include one or more components, such as a transmission (e.g., a continuously variable transmission (CVT), a hybrid transmission, and/or the like), one or more drive shafts, one or more differentials, one or more final drives, one or more axle systems, one or more braking systems, and/or the like. Powertrain system 210 may use one or more oils, such as a transmission oil, a drive shaft oil, an axle oil, a brake oil, and/or the like, to provide lubrication for one or more components of powertrain system 210 and/or to cool one or more components of powertrain system 210. Powertrain system 210 may include one or more systems, such as a transmission oil circulation system, a drive shaft oil circulation system, an axle oil circulation system, a brake oil circulation system, and/or the like to circulate the oil through the powertrain system 210.

Second radiator 212 may fluidly connect to powertrain system 210. For example, second radiator 212 may be connected to powertrain system 210 via conduits, hoses, and/or the like, to allow the oil to circulate through powertrain system 210 and second radiator 212 to cool the oil. Second radiator 212 may be an oil-to-air cooler to cool the oil. Second fan 214 may be mounted on, integrated into, attached to, and/or affixed to second radiator 212. Second fan 214 may direct airflow at second radiator 212 to facilitate cooling of the oil as the oil circulates through second radiator 212. For example, second fan 214 may be pointed toward second radiator 212 to direct airflow produced by second fan 214 at second radiator 212 to cool second radiator 212 and thereby facilitate cooling the oil. As another example, second fan 214 may be pointed away from second radiator 212 to draw heat produced by second radiator 212 away from second radiator 212 and to direct airflow of fresh air at second radiator 212. Second fan 214 may produce an amount of airflow within an airflow amount range, such as 5,000-45,000 cubic meters per hour. Second fan 214 may have one or more speeds. As one example, second fan 214 may have a first speed of 600 RPM, a second speed of 2,750 RPM, and a third speed of 3,150 RPM. Second fan 214 may operate via a mechanically driven component of engine 202, via direct current electricity generated by engine 202, and/or the like.

Second temperature sensor 216 may be an oil temperature sensor. Second temperature sensor 216 may determine a temperature associated with powertrain system 210 and/or the oil used by powertrain system 210, such as a temperature of the powertrain system 210, a temperature of a component of the powertrain system 210, a temperature of the oil, and/or the like. The second temperature sensor 216 may send second temperature data (e.g., second temperature data concerning the temperature associated with powertrain system 210 and/or the oil used by powertrain system 210) to controller 220 via the one or more electrical connections. The second temperature sensor 216 may send a signal to controller 220 indicating whether the temperature of the oil satisfies a second temperature threshold (e.g., whether the temperature of the oil is greater than or equal to the second temperature threshold, whether the temperature of the oil is less than the second temperature threshold, and/or the like).

Heat exchanger 218 may fluidly connect to engine 202, first radiator 204, powertrain system 210, and/or second radiator 212. For example, heat exchanger 218 may connect to engine 202 and first radiator 204 via conduits, hoses, and/or the like, to allow the liquid coolant to circulate through engine 202, first radiator 204, and heat exchanger 218. A pump (not shown), such as a jacket water pump, may assist in circulating the liquid coolant through engine 202, first radiator 204, and heat exchanger 218, as shown in FIG. 2 via the solid line arrows. As another example, heat exchanger 218 may connect to powertrain system 210 and second radiator 212 via conduits, hoses, and/or the like, to allow the oil to circulate through powertrain system 210, second radiator 212, and heat exchanger 218. The pump, or another pump, may assist in circulating the oil through powertrain system 210, second radiator 212, and heat exchanger 218, as shown in FIG. 2 via the dashed line arrows. Heat exchanger 218 may include one or more coolers (e.g., a liquid-coolant-to-water cooler, an oil-to-water cooler, and/or the like) to cool the liquid coolant and/or the oil. While passing through heat exchanger 218, heat from the liquid coolant is transferred to the oil when the oil is cooler than the liquid coolant, and/or heat from the oil is transferred to the liquid coolant when the liquid coolant is cooler than the oil.

Controller 220 may include one or more devices that provide control of first fan 206 and/or second fan 214. Controller 220 may connect to first fan 206, first temperature sensor 208, second fan 214, and/or second temperature sensor 216 via the one or more electrical connections, as shown by the dotted lines in FIG. 2. In some implementations, an electrical connection, of the one or more electrical connections, may be an electrical circuit. The one or more electrical connections may allow signals, messages, and/or the like to transmit from one electrical component to another electrical component. For example, first temperature sensor 208 may send first temperature data and second temperature sensor 216 may send second temperature data to controller 220 via the one or more electrical connections. As another example, controller 220 may send one or more control signals to first fan 206 and/or second fan 214 via the one or more electrical connections.

Controller 220 may include a central processing unit (CPU), a microprocessor, a microcontroller, a control unit, an engine control unit, a processor, or another type of processing component. Controller 220 may include one or more processors capable of being programmed to perform a function. Controller 220 may include one or more memories, such as a random access memory (RAM), a read only memory (ROM), and/or another type of dynamic or static storage device (e.g., a flash memory, a magnetic memory, and/or an optical memory) that stores information and/or instructions for use by controller 220.

Controller 220 may execute the instructions to perform various control functions and processes to control first fan 206 and/or second fan 214. In some implementations, controller 220 may selectively operate first fan 206 and/or second fan 214 (e.g., activate and/or deactivate first fan 206 and/or second fan 214, turn on or off first fan 206 and/or second fan 214, adjust a speed of first fan 206 and/or a speed of second fan 214, and/or the like). For example, controller 220 may send one or more signals to first fan 206 to cause first fan 206 to activate, deactivate, adjust a speed of first fan 206, and/or the like. As another example, controller 220 may send one or more signals to second fan 214 to cause second fan 214 to activate, deactivate, adjust a speed of second fan 214, and/or the like. As an additional example, controller 220 may send one or more signals to first fans 206 to individually control each first fan 206 (e.g., to activate, deactivate, adjust a speed of each first fan 206). In another example, controller 220 may send one or more signals to second fans 214 to individually control each second fan 214 (e.g., to activate, deactivate, adjust a speed of each second fan 214).

Controller 220 may obtain the first temperature data from first temperature sensor 208 and/or the second temperature data from second temperature sensor 216 to control operation of first fan 206 and/or second fan 214. Controller 220 may selectively turn on and/or off first fan 206, control a speed of first fan 206, turn on and/or off second fan 214, control a speed of second fan 214, and/or the like based on the first temperature data and/or the second temperature data.

For example, controller 220 may turn on first fan 206 and/or second fan 214 (e.g., activate first fan 206 and/or second fan 214) when the first temperature data indicates that the temperature of the liquid coolant satisfies a first temperature threshold (e.g., the temperature of the liquid coolant is greater than or equal to the first temperature threshold) and/or the second temperature data indicates that the temperature of the oil satisfies a second temperature threshold (e.g., the temperature of the oil is greater than or equal to the second temperature threshold). As another example, controller 220 may turn off first fan 206 and/or second fan 214 (e.g., deactivate first fan 206 and/or second fan 214) when the first temperature data indicates that the temperature of the liquid coolant does not satisfy the first temperature threshold (e.g., the temperature of the liquid coolant is less than the first temperature threshold) and/or the second temperature data indicates that the temperature of the oil does not satisfy the second temperature threshold (e.g., the temperature of the oil is less than the second temperature threshold). In another example, controller 220 may turn on first fan 206 and/or turn off second fan 214 when the first temperature data indicates that the temperature of the liquid coolant satisfies the first temperature threshold and/or the second temperature data indicates that the temperature of the oil does not satisfy the second temperature threshold. In an additional example, controller 220 may turn off first fan 206 and/or turn on second fan 214 when the first temperature data indicates that the temperature of the liquid coolant does not satisfy the first temperature threshold and/or the second temperature data indicates that the temperature of the oil satisfies the second temperature threshold.

Controller 220 may control the speed of first fan 206 and/or second fan 214 when the first temperature data indicates that the temperature of the liquid coolant is within a first particular temperature range and/or the second temperature data indicates that the temperature of the oil is within a second particular temperature range. In one example, controller 220 may send a signal to first fan 206 to operate at a minimum speed (e.g., 600 RPM) when the first temperature data indicates that the temperature of the liquid coolant is within a first particular temperature range (e.g., the liquid coolant temperature is within 89 to 99 degrees Celsius) and/or the temperature of the oil is within a second particular temperature range (e.g., the brake oil temperature is within 100 to 105 degrees Celsius, the transmission oil temperature is within 100 to 103 degrees Celsius, and/or the like). The controller may send a signal to first fan 206 to operate at a maximum speed (e.g., 2,300 RPM) when the first temperature data indicates that the temperature of the liquid coolant is outside the first particular temperature range and satisfies the first temperature threshold (e.g., the liquid coolant temperature is greater than or equal to 100 degrees Celsius) and/or the temperature of the oil is outside the second particular temperature range and satisfies the second temperature threshold (e.g., the brake oil temperature is greater than or equal to 106 degrees Celsius, the transmission oil temperature is greater than or equal to 104 degrees Celsius, and/or the like). In another example, controller 220 may send a signal to second fan 214 to operate at a minimum speed (e.g., 600 RPM) when the first temperature data indicates that the temperature of the liquid coolant is within a first particular temperature range (e.g., the liquid coolant temperature is within 89 to 99 degrees Celsius) and/or the temperature of the oil is within a second particular temperature range (e.g., the brake oil temperature is within 100 to 105 degrees Celsius, the transmission oil temperature is within 100 to 103 degrees Celsius, and/or the like). The controller may send a signal to second fan 214 to operate at a maximum speed (e.g. 3,150 RPM) when the first temperature data indicates that the temperature of the liquid coolant is outside the first particular temperature range and satisfies the first temperature threshold (e.g., the liquid coolant temperature is greater than or equal to 100 degrees Celsius) and/or the temperature of the oil is outside the second particular temperature range and satisfies the second temperature threshold (e.g., the brake oil temperature is greater than or equal to 106 degrees Celsius, the transmission oil temperature is greater than or equal to 104 degrees Celsius, and/or the like).

Controller 220 may receive a signal indicating whether the temperature of the liquid coolant satisfies the first temperature threshold from first temperature sensor 208. Controller 220 may activate and/or deactivate first fan 206 and/or second fan 214 based on the signal indicating whether the temperature of the liquid coolant satisfies the first temperature threshold from first temperature sensor 208 (e.g., activate first fan 206 and/or second fan 214 if the signal indicates that the temperature of the liquid coolant satisfies the first temperature threshold, deactivate first fan 206 and/or second fan 214 if the signal indicates that the temperature of the liquid coolant does not satisfy the first temperature threshold, and/or the like) in a similar manner as that described herein.

Controller 220 may receive a signal indicating whether the temperature of the liquid coolant satisfies the first temperature threshold from first temperature sensor 208. Controller 220 may activate and/or deactivate first fan 206 and/or second fan 214 based on the signal indicating whether the temperature of the oil satisfies the second temperature threshold from second temperature sensor 216 (e.g., activate first fan 206 and/or second fan 214 if the signal indicates that the temperature of the oil satisfies the second temperature threshold, deactivate first fan 206 and/or second fan 214 if the signal indicates that the temperature of the oil does not satisfy the second temperature threshold, and/or the like) in a similar manner as that described herein.

The number and arrangement of components shown in FIG. 2 are provided as an example. In practice, there may include additional components, fewer components, different components, or differently arranged components than those shown in FIG. 2. Additionally, or alternatively, a set of components (e.g., one or more components) of distributed cooling system 200 may perform one or more functions described as being performed by another set of components of distributed cooling system 200.

Figure 3:
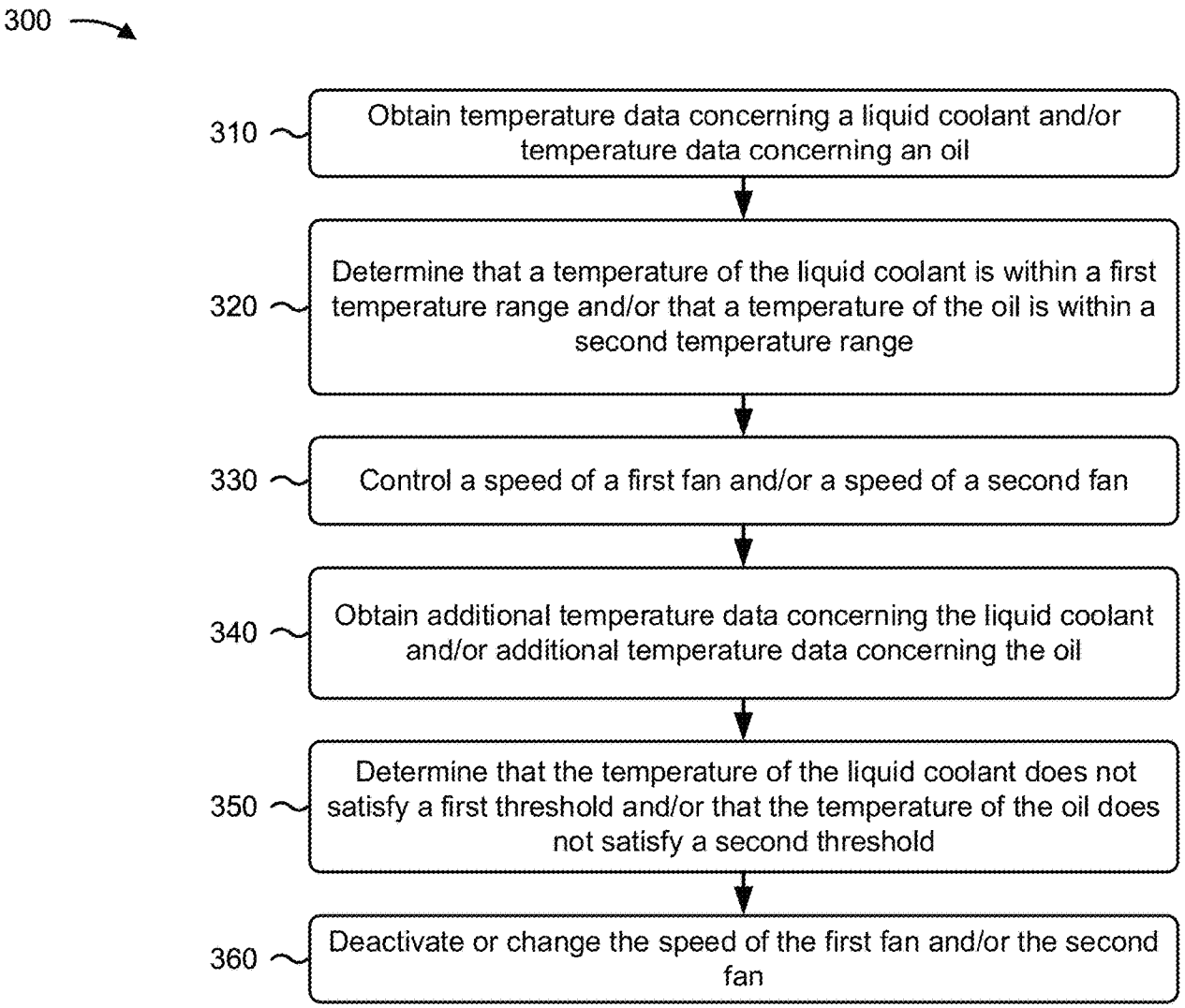
FIG. 3 is a diagram of an example process associated with a distributed cooling system for a work machine.

FIG. 3 is a flow chart of an example process 300 associated with a distributed cooling system for a work machine. In some implementations, one or more process blocks of FIG. 3 may be performed by a controller (e.g., controller 220). In some implementations, one or more process blocks of FIG. 3 may be performed by another device or a group of devices separate from or including the controller, such as an engine (e.g., engine 202), a first radiator (e.g., first radiator 204), a first fan (e.g., first fan 206), a first temperature sensor (e.g., first temperature sensor 208), a powertrain system (e.g., powertrain system 210), a second radiator (e.g., second radiator 212), a second fan (e.g., second fan 214), a second temperature sensor (e.g., second temperature sensor 216), a heat exchanger (e.g., heat exchanger 218), and/or the like.

As shown in FIG. 3, process 300 may include obtaining temperature data concerning a liquid coolant and/or temperature data concerning an oil (block 310). For example, the controller (e.g., using one or more processors, one or more memories, and/or the like) may obtain temperature data concerning a liquid coolant and/or temperature data concerning an oil, as described above.

As shown in FIG. 3, process 300 may include determining that a temperature of the liquid coolant is within a first temperature range and/or that a temperature of the oil is within a second temperature range (block 320). For example, the controller (e.g., using one or more processors, one or more memories, and/or the like) may determine that a temperature of the liquid coolant is within a first temperature range and/or that a temperature of the oil is within a second temperature range, as described above.

As shown in FIG. 3, process 300 may include controlling a speed of a first fan and/or a speed of a second fan (block 330). For example, the controller (e.g., using one or more processors, one or more memories, and/or the like) may control a speed of a first fan and/or a speed of a second fan, as described above.

As shown in FIG. 3, process 300 may include obtaining additional temperature data concerning the liquid coolant and/or additional temperature data concerning the oil (block 340). For example, the controller (e.g., using one or more processors, one or more memories, and/or the like) may obtain additional temperature data concerning the liquid coolant and/or additional temperature data concerning the oil, as described above.

As shown in FIG. 3, process 300 may include determining that the temperature of the liquid coolant does not satisfy a first threshold and/or that the temperature of the oil does not satisfy a second threshold (block 350). For example, the controller (e.g., using one or more processors, one or more memories, and/or the like) may determine that the temperature of the liquid coolant does not satisfy a first threshold and/or that the temperature of the oil does not satisfy a second threshold, as described above.

As shown in FIG. 3, process 300 may include deactivating or changing the speed of the first fan and/or the second fan (block 360). For example, the controller (e.g., using one or more processors, one or more memories, and/or the like) may deactivate or change the speed of the first fan and/or the second fan, as described above.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

In some instances, a work machine may include numerous components, such as an engine, a powertrain system, and/or the like that become hot and need to be cooled. In some instances, the work machine may use a cooling system that includes a radiator, a heat exchanger, a fan, and/or the like to cool a liquid coolant that is to cool the engine and an oil that is to cool the powertrain system. However, the fan often runs at maximum speed to cool the liquid coolant and the oil, even when only one of the liquid coolant and the oil is hot. Operating the fan in this way uses a significant amount of energy that decreases the efficiency of the cooling system. Moreover, continuously running the fan at a maximum speed increases fan noise levels that may inhibit an operator's ability to optimally operate the work machine.

According to some implementations herein a distributed cooling system (e.g., distributed cooling system 200) includes a first radiator (e.g., first radiator 204) to cool a liquid coolant that cools an engine (e.g., engine 202), a first fan (e.g., first fan 206), connected to the first radiator, to facilitate cooling the liquid coolant, and a first temperature sensor (e.g., first temperature sensor 208) to obtain first temperature data concerning the liquid coolant. The distributed cooling system includes a second radiator (e.g., second radiator 212) to cool an oil that lubricates a powertrain system (e.g., powertrain system 210), a second fan (e.g., second fan 214), connected to the second radiator, to facilitate cooling the oil, and a second temperature sensor (e.g., second temperature sensor 216) to obtain second temperature data concerning the oil. The distributed cooling system includes a heat exchanger (e.g., heat exchanger 218) to facilitate the liquid coolant cooling the oil and the oil cooling the liquid coolant and includes a controller (e.g., controller 220), electrically connected to the first fan, the first temperature sensor, the second fan, and the second temperature sensor to control the first fan and the second fan.

Accordingly, the controller may obtain the first temperature data from the first temperature sensor and the second temperature data from the second temperature sensor to selectively control the first fan and the second fan. The controller may selectively operate the first fan and the second fan to facilitate cooling the liquid coolant and/or the oil. For example, the controller may activate the first fan and the second fan when the liquid coolant is hot and the oil is cool so that the first fan may facilitate cooling the liquid coolant as the liquid coolant circulates through the first radiator and that the second fan may cool the oil to an even cooler temperature, which enables the liquid coolant to transfer even more heat to the oil as the liquid coolant and oil circulate through the heat exchanger. As another example, the controller may activate the first fan and the second fan when the liquid coolant is cool and the oil is hot so that the first fan may facilitate cooling the liquid coolant to an even cooler temperature as the liquid coolant circulates through the first radiator and that the second fan may cool the oil, which enables the oil to transfer even more heat to the liquid coolant as the liquid coolant and oil circulate through the heat exchanger.

This improves the cooling ability of the distributed cooling system, which in turn allows the work machine to operate in hotter ambient conditions than the work machine otherwise could. Moreover, this reduces the overall consumption of power for fan operation because the first fan and second fan need to operate at a maximum speed for a lesser amount of time than a single fan needs to operate at maximum speed for a traditional cooling system. Further, because the first fan and the second fan spend less time operating at a maximum speed, fan noise levels are decreased, which improves working conditions for the operator of the working machine.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. A system, comprising:

a first radiator to circulate a liquid coolant through the first radiator to cool the liquid coolant;

a first fan, connected to the first radiator, to facilitate cooling the liquid coolant;

a first temperature sensor to obtain first temperature data concerning the liquid coolant;

a second radiator to circulate an oil through the second radiator to cool the oil;

a second fan, connected to the second radiator, to facilitate cooling the oil;

a second temperature sensor to obtain second temperature data concerning the oil;

a heat exchanger to cool the liquid coolant and the oil; and a controller, electrically connected to the first fan, the first temperature sensor, the second fan, and the second temperature sensor to individually control the first fan and the second fan, wherein, when individually controlling the first fan and the second fan, the controller is to:

activate the first fan and the second fan when the first temperature data concerning the liquid coolant indicates that a temperature of the liquid coolant is below a first temperature threshold and the second temperature data concerning the oil indicates that a temperature of the oil satisfies a second temperature threshold.

2. The system of claim 1, wherein the first fan is to direct airflow at the first radiator when the liquid coolant circulates through the first radiator.

3. The system of claim 1, wherein the second fan is to direct airflow to the second radiator when the oil circulates through the second radiator.

4. The system of claim 1, wherein the controller is to obtain the first temperature data concerning the liquid coolant from the first temperature sensor and the second temperature data concerning the oil from the second temperature sensor.

5. The system of claim 1, wherein, when individually controlling the first fan and the second fan, the controller is further to control, based on the first temperature data concerning the liquid coolant and the second temperature data concerning the oil, a speed of the first fan.

6. The system of claim 1, wherein the first fan has a first plurality of speeds and the second fan has a second plurality of speeds, and wherein the second plurality of speeds is different from the first plurality of speeds.

7. The system of claim 1, wherein the first fan is one of a plurality of first fans, connected to the first radiator, to facilitate cooling the liquid coolant, and wherein the plurality of first fans are pointed toward the first radiator, and wherein the second fan is one of a plurality of second to facilitate cooling the oil and pointed away from the second radiator.

8. A cooling system, comprising:

a first radiator to cool a liquid coolant that cools an engine;

a first fan, connected to the first radiator, to facilitate cooling the liquid coolant;

a first temperature sensor to obtain first temperature data concerning the liquid coolant;

a second radiator to cool an oil that lubricates a powertrain system;

a second fan, connected to the second radiator, to facilitate cooling the oil;

a second temperature sensor to obtain second temperature data concerning the oil;

a heat exchanger to facilitate the liquid coolant cooling the oil and the oil cooling the liquid coolant; and a controller, electrically connected to the first fan, the first temperature sensor, the second fan, and the second temperature sensor to control the first fan and the second fan, wherein, when controlling the first fan and the second fan, the controller is to:

control, based on the first temperature data concerning the liquid coolant and the second temperature data concerning the oil, the first fan to operate at a speed, of a plurality of speeds of the first fan, when the first temperature data concerning the liquid coolant indicates that a temperature of the liquid coolant is below a first temperature threshold and the second temperature data concerning the oil indicates that a temperature of the oil is above a second temperature threshold.

9. The cooling system of claim 8, wherein, when controlling the plurality of first fans and the second fan, the controller is to:

turn on the first fan based on the first temperature data concerning the liquid coolant and the second temperature data concerning the oil.

10. The cooling system of claim 8, wherein, when controlling the plurality of first fans and the second fan, the controller is to:

turn on the second fan based on at least on one of the first temperature data concerning the liquid coolant or the second temperature data concerning the oil.

11. The cooling system of claim 8, wherein, when controlling the plurality of first fans and the second fan, the controller is to:

control a speed of the second fan based on at least on one of the first temperature data concerning the liquid coolant or the second temperature data concerning the oil.

12. The cooling system of claim 8, wherein the speed is less than a maximum speed of the plurality of speeds of the first fan.

13. A machine, comprising:

an engine;

a brake oil circulation system;

a heat exchanger to fluidly connect with one or more of:

the engine, or the brake oil circulation system, wherein the heat exchanger is configured to facilitate cooling of:

a liquid coolant that cools the engine, or a brake oil used in the brake oil circulation system;

a first radiator to fluidly connect with the engine, wherein the first radiator is configured to cool the liquid coolant that cools the engine;

a first fan, coupled to the first radiator, configured to facilitate cooling the liquid coolant;

a second radiator to fluidly connect with the brake oil circulation system, wherein the second radiator is configured to cool the brake oil used in the brake oil circulation system;

one or more second fans, coupled to the second radiator, configured to facilitate cooling the brake oil; and a controller, electrically connected with the first fan and the or more second fans to control at least the first fan and the one or more second fans to facilitate one or more of cooling the liquid coolant or cooling the brake oil, wherein, when controlling at least the first fan and the one or more second fans, the controller is to:

activate the first fan based on first data indicating that the liquid coolant is cool and second data indicating that the brake oil is hot.

14. The machine of claim 13, further comprising:

a first temperature sensor configured to obtain first temperature data concerning the liquid coolant, wherein the first temperature sensor is electrically connected to the controller to provide the first temperature data to the controller, and wherein the first data includes the first temperature data; and a second temperature sensor to obtain second temperature data concerning the brake oil, wherein the second temperature sensor is electrically connected to the controller to provide the second temperature data to the controller, and wherein the second data includes the second temperature data.

15. The machine of claim 13, wherein, when controlling at least the first fan and the one or more second fans, the controller is further to:

selectively control a speed of the first fan based on the first data and the second data.

16. The machine of claim 13, wherein, when controlling at least the first fan and the one or more second fans, the controller is further to:

control a speed of the first fan based on a temperature of the liquid coolant indicated by the first data and a temperature of the brake oil indicated by the second data.

17. The machine of claim 13, wherein the controller is further to:

deactivate the first fan upon receiving:

a first signal from a first temperature sensor indicating that a temperature of the liquid coolant does not satisfy a first threshold, and a second signal from a second temperature sensor indicating that a temperature of the brake oil does not satisfy a second threshold.

18. The machine of claim 13, wherein the first data includes a first signal from a first temperature sensor indicating that a temperature of the liquid coolant does not satisfy a first threshold associated with the liquid coolant being hot, and wherein the second data includes a second signal from a second temperature sensor indicating that a temperature of the brake oil satisfies a second threshold associated with the brake oil being hot.

19. The machine of claim 13, wherein the controller is further to:

deactivate the first fan and deactivate the second fan upon receiving:

a first signal from a first temperature sensor indicating that a temperature of the liquid coolant does not satisfy a first threshold; and a second signal from a second temperature sensor indicating that a temperature of the brake oil does not satisfy a second threshold.

20. The cooling system of claim 8, wherein the speed is a minimum speed of the first fan, wherein the temperature of the liquid coolant is within a first particular temperature range, wherein the temperature of the oil is within a second particular temperature range, wherein a lower end of the second particular temperature range is higher than a higher end of the first particular temperature range, and wherein, when controlling the first fan and the second fan, the controller is further to:

send a signal to the second fan to operate at a minimum speed, of a plurality of speeds of the second fan, based on the temperature of the liquid coolant being within the first particular temperature range and the temperature of the oil being within the second particular temperature range.

* * * * *